US006056288A

United States Patent [19]

Tsai et al.

[11] Patent Number: 6,056,288

[45] Date of Patent: May 2, 2000

[54] SELF ADJUSTING CONTROLLED ACCELERATION SHEET STACKING OFFSETTING SYSTEM

[75] Inventors: Margaret P. Tsai, Webster; Bruce J. DiRenzo, Rochester, both of N.Y.

[73] Assignee: Xerox Corporation, Stamford, Conn.

[21] Appl. No.: 09/219,743

[22] Filed: Dec. 22, 1998

[51] Int. Cl.[7] ..... B65H 31/04

[52] U.S. Cl. ..... 271/213; 271/210; 271/219; 271/146; 271/286; 271/180; 414/791.2

[58] Field of Search ..... 271/213, 210, 271/219, 146, 286, 180; 414/791.2

[56] References Cited

U.S. PATENT DOCUMENTS

| | | | |
|---|---|---|---|
| 2,697,602 | 12/1954 | Oudenaren | 271/213 |
| 4,664,507 | 5/1987 | Fukae et al. | 355/3 |
| 4,783,066 | 11/1988 | Barker et al. | 271/180 |
| 5,007,625 | 4/1991 | Kremers et al. | 270/53 |
| 5,088,721 | 2/1992 | Suzuki et al. | 271/293 |
| 5,173,785 | 12/1992 | Muramatsu | 358/400 |
| 5,431,387 | 7/1995 | Loben et al. | 271/213 |
| 5,676,366 | 10/1997 | Palidoro | 271/176 |

*Primary Examiner*—Christopher P. Ellis
*Assistant Examiner*—Richard Ridley

[57] ABSTRACT

A sheet stacking offsetting system with a stacking tray offsetting movement system with which printed sheets from a reproduction apparatus are stacked offset relative to one another, with a simple rotary drive of an eccentrically rotated extending pin cam which reciprocally drives a simple two part cam follower providing a variable width cam follower slot positively engaging the eccentrically rotated cam to smoothly reciprocate the sheet stacking tray. The slot width is automatically reduced by spring loading movement of one of the two parts of the cam follower so that both sides of said slot directly engage the eccentrically rotated cam at all times. The cam follower slot is also open ended and beveled to easily assemble the pin cam into that open end.

5 Claims, 2 Drawing Sheets

SELF ADJUSTING CONTROLLED ACCELERATION SHEET STACKING OFFSETTING SYSTEM

Disclosed in the embodiments herein is an improved system for the offset stacking of sheets or sets of sheets being outputted by a printer or other reproduction apparatus, especially by stacking tray position shifting, which is low-cost, easier to assemble, and yet more accurate and self-compensating for wear, with better acceleration control.

It is important to provide accurate offsetting of the separate print jobs or sets of printed sheets being outputted from a reproduction apparatus. It allows the offset sets to be distinguished from one another, and separately manually removed, if desired, with set integrity. That is especially valuable for a shared user printer with a common stacking output of either finished or unfinished sets from different users. A common method for providing set offsetting is to laterally (transversely of the sheet output path) shift the output stacking tray between the last sheet of one set and the first sheet of the next set being complied on that stacking tray, or in between finished sets if the output is stapled, bound or otherwise finished. Sheets offsetting may also be done for individual "banner sheets," also providing set separation and set distinguishing.

Figure 2:
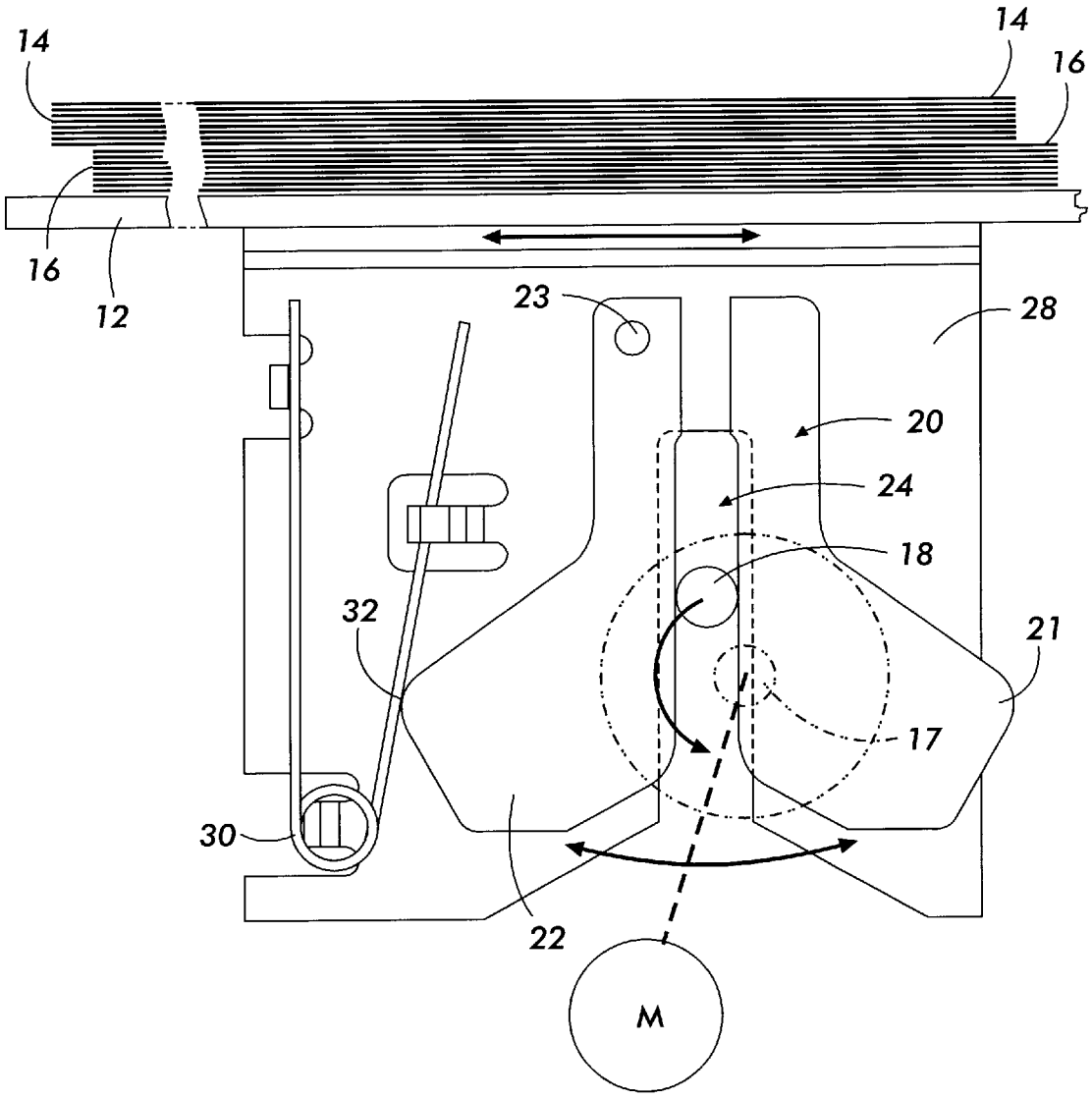

A particular example of a prior art tray offsetting system, using lateral tray shifting, is particularly shown in FIGS. 2 and 3 of U.S. Pat. No. 5,639,080, issued Jun. 17, 1997 to J. Brian Evans (Xerox Corporation). (This patent also illustrates that orthogonal offsetting may also be provided, as for purge sheets offsetting.) As shown particularly in said FIG. 3, offsetting there is provided by a motor M rotating a barrel cam 30 track in which a pin 32 rides for lateral translation of the tray 15. The tray 15 is laterally slideably mounted to the frame of the reproduction machine or the attached output module. However, the manufacturability and assembly of the entire barrel cam drive mechanism is time-consuming and fairly costly, involving several parts. Also, the clearance between the curved track or slot in the barrel cam and the follower pin is substantial, and can increase with wear, and a wider slot leads to poor offset performance. The follower pin 32 driving the offset tray 15 can shift and engage uncontrollably from side to side within the enlarged or oversized slot in the barrel cam. Such "slop" or excess clearance in the cam 30 slot width, as compared to the cam follower pin 32 diameter, can result in the elevator tray 15 shifting in an uncontrolled manner. It can cause excessive acceleration or deceleration forces which can skew or otherwise disturb the alignment of the stack of output papers which are lying on top of the tray 15 being laterally moved from side to side of the paper output path by that mechanism. With such an arrangement, it may be required to provide controlled motor velocity profiles, so that the acceleration and deceleration of the tray 15 can be more gradual, to keep those forces under 0.2 G's, but even this cannot fully compensate for "slop" and/or "backlash" in the reciprocal drive system of that prior type, particularly with wear.

The set offsetting system disclosed herein overcomes disadvantages of the above and various other tray offsetting systems. It provides ease of assembly or disassembly and provides automatic elimination of tolerance errors between the cam and cam follower mechanism from either manufacturing or wear. It is a very simple mechanism with very few parts, yet provides the desired smooth and accurately consistent back and forth linear motion of the tray. Maintenance of square stacking of the offset stacks (particularly as the stacks increase in height on the stacking tray) is particularly improved due to improved acceleration and deceleration control, especially, the absence of any high acceleration and high deceleration impacts on the tray from engagement slack or play anywhere in the entire drive chain of the offset system mechanism.

A specific feature of the specific embodiment disclosed herein is to provide in a sheet stacking and offsetting system with a movable sheet stacking tray, and a stacking tray offsetting movement system for said movable stacking tray, by which flimsy printed sheets from a reproduction apparatus are stacked on said output stacking tray with selected sheets are offset relative to one another, the improvement comprising: a rotary drive system with an eccentrically rotated camming member, a cam follower system with a variable width cam follower slot engaging said eccentrically rotated camming member, said cam follower system being operatively connected to said movable sheet stacking tray to provide said stacking tray offsetting movement by said eccentric rotation of said camming member in said variable width cam follower slot, and said cam follower system having an automatic positive cam engagement system for automatically reducing the width of said cam follower slot so that both sides of said slot directly engage said eccentrically rotated camming member.

Further specific features disclosed herein, individually or in combination, include those wherein said cam follower system comprises a two part cam follower member which defines said cam follower slot between said two parts, and wherein at least one of said two parts is spring loaded towards the other said part to directly engage said eccentrically rotated camming member to provide said automatic positive cam engagement system for automatically reducing the width of said cam follower slot; and/or wherein one said part of said two part cam follower system is pivotally mounted; and/or wherein said eccentrically rotated camming member is a cylindrical extending pin; and/or wherein said cam follower slot is open ended to receive said eccentrically rotated camming member into said open end.

In the description herein the term "sheet" refers to a usually flimsy physical sheet of paper, plastic, or other suitable physical substrate for images, whether precut or web fed. A "copy sheet" may be abbreviated as a "copy", or called a "hardcopy". A "job" is normally a set of related sheets, usually a collated copy set copied from a set of original document sheets or electronic document page images, from a particular user, or otherwise related. The different types, functions, and controls for sheet stacking with offsetting are well known and need not be described herein.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Figure 1:
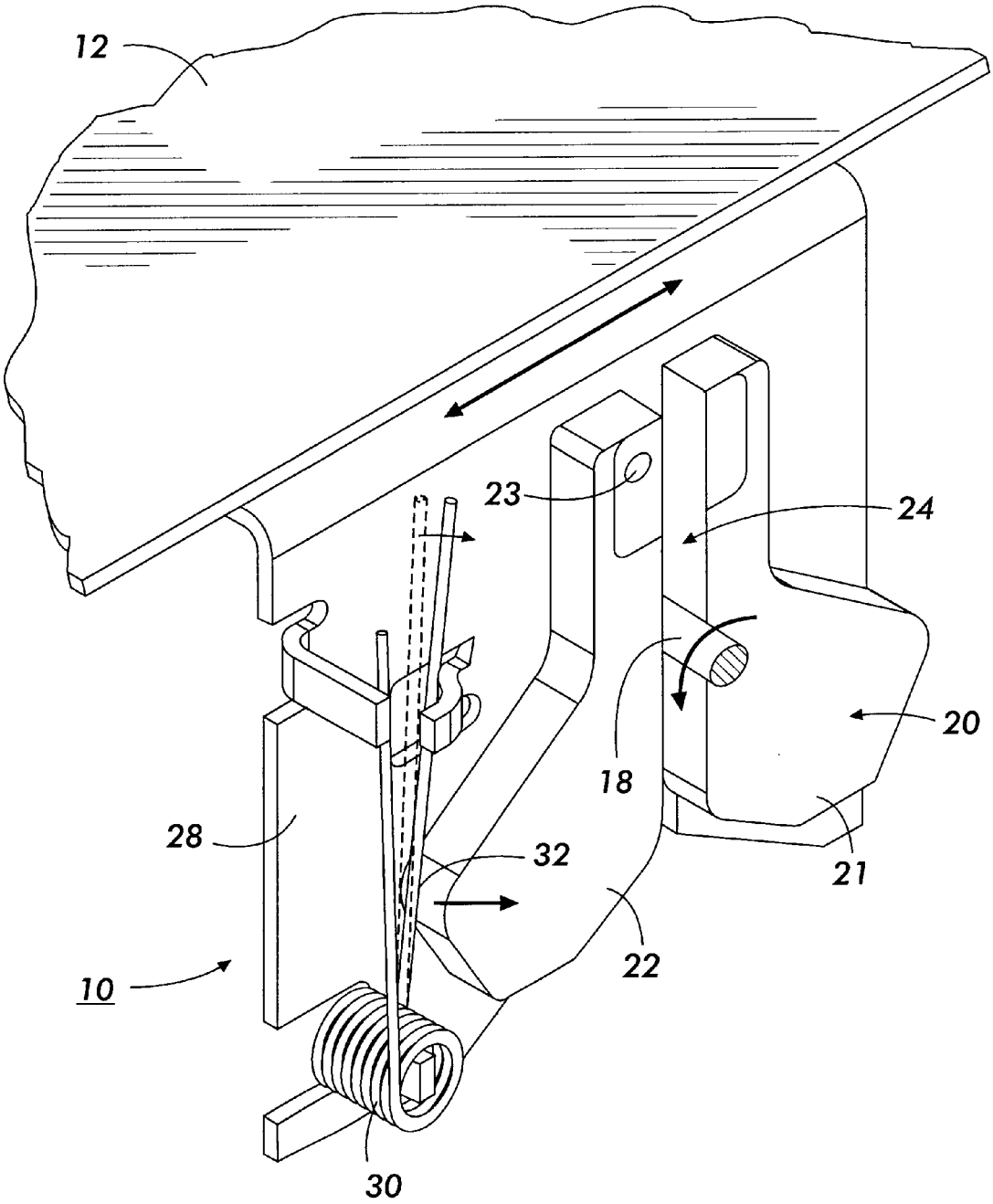

Various of the above-mentioned and further features and advantages will be apparent from the specific apparatus and its operation described in the example below, and the claims. Thus, the present invention will be better understood from this description of a specific embodiment, including the drawing figures (approximately to scale) wherein:

FIG. 1 is a perspective view of one example of the subject tray offsetting system, also showing a broken-away portion of the attached overlying sheet stacking tray; and FIG. 2 is a side or output end view of the tray offsetting system embodiment of FIG. 1, showing thereon the broken away portion of the exemplary stacking tray, and also showing (broken-away foreshortening) the offset lateral ends of offset paper stacks or sets being offset by the operation of this embodiment.

Referring to the exemplary tray offsetting system example 10 of FIGS. 1 and 2, this system 10 is shown providing smooth reciprocal lateral offsetting of an output stacking tray 12 mounted for reciprocal movement. It will be appreciated that various output trays, including elevator tray mechanisms, "mailbox" stacking trays, or any other system requiring offsetting of either individual sheets or sets of the sheets, may utilize the illustrated system 10. FIG. 2 shows, for illustrative purposes, two relatively offset sheet stacks 14 and 16 on the tray 12 provided by the system 10 operation. The desired amount of offsetting can be changed simply by changing the amount of eccentricity, or crank arm length, of the offsetting system. That is a matter of design or customer desire, which need not be discussed herein. These and other offset system aspects are well-known to those skilled in the art of sheet stacking and offsetting and need not be described herein.

In this example, the drive for the system 10 may be provided by a simple motor M which has a simple output disk or crank providing an eccentric pin cam 18 extending therefrom rotating about the axis of rotation 17 of the motor M by a defined radius. That defines the amount of relative offsetting of the sequential stacks on the tray 12 as the pin 18 is rotated by the motor M. The motor M, of course, is mounted to the non-reciprocating portion of the frame of the output module or reproduction apparatus.

The cylindrical pin cam 18 rides in, and drives, a cam follower system 20, comprising on one side a stationary or fixed guide or member 21 and on the opposite side a pivoting or otherwise moveable guide or member 22. The inside surfaces of the members 21 or 22 define a vertical slot 24, which is open at the bottom for ease of assembly onto the pin 18. The bottom surfaces of the members 21 and 22 are inwardly beveled inclined surfaces to assist in guiding the pin 18 into the slot 24 when the tray unit is assembled relative to the Motor M and its eccentric pin 18. Both of the members 21 and 22 of the cam follower system are mounted to a frame 28, which in turn is secured to the sheet stacking tray 12. Thereby, as the pin 18 rotates eccentrically, it provides gradual acceleration and deceleration, first in one direction, then in the other, of the cam follower system 20, and hence the tray 12 and all the paper sheets stacked thereon. The variable vector angle of constant engagement of the pin 18 with the vertical slot 24 allows constant rotation of motor M to provide gradual acceleration and deceleration.

The pin 18 has a fixed cylindrical shape and is preferably of a wear resistant material, such as a steel pin. The slot 24, however, has a variable width to conform in width to the diameter of the pin 18. This eliminates all manufacturing tolerances, play, or wear in the engagement between the surfaces of the pin 18 and the inner surfaces of the members 21 and 22 defining the pin engaging slot 24. This is provided by spring loading the movable member 22 towards the fixed member, such as a spring 30. The spring 30 here engages the movable member 22 at an engagement area 32 to continuously pinch, with a controlled force, the pin 18 in the variable width conforming slot 24 by holding the member 22 against the pin 18, which in turn directly engages the member 21. The spring force of the spring 30 engagement 32 is sufficient to prevent the slot 24 from opening by the pin 18 rotation, even for a fully loaded tray 12, but not so strong as to excessively bind the pin 18 in the slot 24. The movable member 22 may be pivotally mounted by a mounting pin 23, or otherwise.

In effect, there is a self-adjusting clamping of the pin 18 by both sides of the slot 24. Thus the circular rotation of the pin 18 about the axis 17 of motor M is converted into smooth linear reciprocal motion of the stacking tray 12, without any abrupt engagements, because the pin 18 is never out of contact with both sides of the cam follower slots 24.

Although a two-part cam follower system 20 is shown in the above-described example, alternatively, members 21 and 22 could be a single plastic part with a relatively thin, flexible, connection at the top, so that the movable side 22 thereof can be flexed towards the fixed side 21 thereof by the spring 30 engagement.

While the embodiment disclosed herein is preferred, it will be appreciated from this teaching that various alternatives, modifications, variations or improvements therein may be made by those skilled in the art, which are intended to be encompassed by the following claims.

What is claimed is:

1. In a sheet stacking and offsetting system with a movable sheet stacking tray, and a stacking tray offsetting movement system for said movable stacking tray, by which flimsy printed sheets from a reproduction apparatus are stacked on said output stacking tray with selected sheets are offset relative to one another, the improvement comprising:

a rotary drive system with an eccentrically rotated camming member, and a cam follower system with a variable width cam follower slot engaging said eccentrically rotated camming member, said cam follower system being operatively connected to said movable sheet stacking tray to provide said stacking tray offsetting movement by said eccentric rotation of said camming member in said variable width cam follower slot, said cam follower system having an automatic positive cam engagement system for automatically reducing the width of said cam follower slot so that both sides of said slot directly engage said eccentrically rotated camming member.

2. The sheet stacking and offsetting system of claim 1, wherein said cam follower system comprises a two part cam follower member which defines said cam follower slot between said two parts, and wherein at least one of said two parts is spring loaded towards the other said part to directly engage said eccentrically rotated camming member to provide said automatic positive cam engagement system for automatically reducing the width of said cam follower slot.

3. The sheet stacking and offsetting system of claim 2, wherein one said part of said two part cam follower system is pivotally mounted.

4. The sheet stacking and offsetting system of claim 1, wherein said eccentrically rotated camming member is a cylindrical extending pin.

5. The sheet stacking and offsetting system of claim 1, wherein said cam follower slot is open ended to receive said eccentrically rotated camming member into said open end.

* * * * *